US009307814B2

(12) United States Patent
Pulliam

(10) Patent No.: US 9,307,814 B2
(45) Date of Patent: Apr. 12, 2016

(54) CONVERTIBLE TOTE PURSE

(71) Applicant: Bernadette May Pulliam, Columbus, OH (US)

(72) Inventor: Bernadette May Pulliam, Columbus, OH (US)

(73) Assignee: Thirty-One Gifts LLC, Columbus, OH (US)

( * ) Notice: Subject to any disclaimer, the term of this patent is extended or adjusted under 35 U.S.C. 154(b) by 204 days.

(21) Appl. No.: 13/945,959

(22) Filed: Jul. 19, 2013

(65) Prior Publication Data

US 2015/0020934 A1 Jan. 22, 2015

Related U.S. Application Data

(63) Continuation-in-part of application No. 29/460,935, filed on Jul. 17, 2013, now Pat. No. Des. 717,041.

(51) Int. Cl.

| | |
|---|---|
| ***A45C 3/06*** | (2006.01) |
| ***A45C 13/00*** | (2006.01) |
| *B65D 33/06* | (2006.01) |
| *B65D 33/14* | (2006.01) |
| *A45C 9/00* | (2006.01) |

(52) U.S. Cl.

CPC . *A45C 3/06* (2013.01); *A45C 13/00* (2013.01); *A45C 2009/007* (2013.01); *B65D 33/06* (2013.01); *B65D 33/14* (2013.01)

(58) Field of Classification Search

CPC .... A45C 3/06; A45C 13/00; A45C 2009/007; B65D 33/06; B65D 33/12

See application file for complete search history.

(56) References Cited

U.S. PATENT DOCUMENTS

| | | | | |
|---|---|---|---|---|
| 811,215 | A * | 1/1906 | Goldmith | 150/108 |
| 2,454,013 | A * | 11/1948 | Scherzinger | 383/2 |
| 4,062,392 | A | 12/1977 | Ishii | |
| 4,153,146 | A * | 5/1979 | Patton et al. | 190/103 |
| 4,194,602 | A * | 3/1980 | Allen | 224/578 |
| 4,813,792 | A * | 3/1989 | Belmont et al. | 383/75 |
| 4,856,570 | A | 8/1989 | Rushing et al. | |
| 5,415,332 | A | 5/1995 | Kliot | |
| 5,699,564 | A * | 12/1997 | Heh | 5/503.1 |
| 7,178,567 | B2 | 2/2007 | Mangano | |
| 7,909,150 | B2 | 3/2011 | Mangano | |
| 8,132,601 | B2 | 3/2012 | Wang | |

(Continued)

OTHER PUBLICATIONS

Google Search for "halogen mixed media convertible tote" before Jun. 19, 2013.*

(Continued)

*Primary Examiner* — Tri Mai

(74) *Attorney, Agent, or Firm* — Porter, Wright, Morris & Arthur, LLP

(57) ABSTRACT

A convertible handbag includes a body having front and rear sides and a bottom forming an interior compartment. The body has a bottom portion including the bottom, a top portion, and an intermediate portion connecting the top and bottom portions. The top portion is foldable into and out of the interior compartment to convert the body between a tote and a purse. Each side has a bottom pair of openings in the intermediate portion and a top pair of openings in the top portion. Front and rear continuous-loops of flexible material extend through both the top and bottom openings so that the continuous-loops can be pulled from the top pairs of openings to form loop handles extending from the top openings when the body is a tote and can be pulled from the bottom openings to form loop handles extending from the bottom openings when the body is a purse.

20 Claims, 5 Drawing Sheets

(56) References Cited

U.S. PATENT DOCUMENTS

| | | | | |
|---|---|---|---|---|
| 2007/0045367 | A1* | 3/2007 | Easom | 224/401 |
| 2009/0050502 | A1* | 2/2009 | Garson | 206/388 |
| 2011/0026857 | A1* | 2/2011 | Bautista | 383/12 |

OTHER PUBLICATIONS

Nordstrom, Halogen(R) Mixed Media Convertible Tote, Mar. 26, 2013, webpage at http://shop.nordstrom.com/s/halogen-mixed-media-convertible-tote/3221864.

* cited by examiner

CONVERTIBLE TOTE PURSE

CROSS-REFERENCE TO RELATED APPLICATIONS

This application is a continuation-in-part of U.S. patent application Ser. No. 29/460,935 filed on Jul. 17, 2013, the disclosure of which is expressly incorporated herein in its entirety by reference.

STATEMENT REGARDING FEDERALLY SPONSORED RESEARCH

Not Applicable

PARTIES TO A JOINT RESEARCH AGREEMENT

Not Applicable

REFERENCE TO APPENDIX

Not Applicable

FIELD OF THE INVENTION

The field of the present invention generally relates to handbags and, more particularly, to handbags convertible between different styles or types of handbags.

BACKGROUND OF THE INVENTION

Most women purchase multiple handbags having different aesthetics and functional configurations to suit different outfits and/or different occasions or needs. However, purchasing additional handbags results in increased costs. Also, using several different handbags can cause logistical issues based on switching personal items between the handbags. For example, anytime a user wants to use a different handbag for whatever reason, the user needs to spend time transferring personal items from one handbag to another. This can also result in the confusion of having various items in several different handbags.

One attempt to solve some of these problems was to provide a handbag with removable covers, skirts, or the like on the exterior of the handbag. When it is desired to change the exterior aesthetic appearance of the handbag, the cover is simple removed and replaced with a cover having a different aesthetic appearance. For example, see U.S. Pat. Nos. 7,607,461 and 7,628,187, the disclosures of which are expressly incorporated herein in their entireties by reference. While these removable covers can change the exterior aesthetic appearance of the handbags, they do not change the style or type of the handbag.

Another attempt to solve some of these problems was to provide a handbag that is expandable to a larger size. For example, see U.S. Pat. Nos. 7,178,567, 7,909,150 and 8,132,601, the disclosures of which are expressly incorporated herein in their entireties by reference. While these expandable handbags can increase and decrease the size of the handbag, they do not change the style or type of the handbag.

Yet another attempt to solve some of these problems was to provide a handbag that is convertible between different types or styles of handbags. For example, see U.S. Pat. No. 4,856,570, the disclosure of which are expressly incorporated herein in its entirety by reference. While these convertible handbags can increase the versatility of the handbag, they are typically time consuming to convert and/or have multiple handles visible in each configuration which can provide a less than ideal appearance.

Accordingly, there is a need in the industry for improved handbags convertible between different styles or types of handbags.

SUMMARY OF THE INVENTION

Disclosed are handbags that overcome at least one deficiency of the prior art handbags described above. Disclosed is a handbag comprising, in combination, a body having a first side, a second side opposed to the first side, and a bottom. The body forms an interior compartment between the sides and above the bottom and an access opening opposite the bottom for accessing the interior compartment. The first side has a first pair of spaced-apart openings and a second pair of spaced apart openings and the second side has a first pair of spaced-apart openings and a second pair of spaced apart openings. A first continuous-loop of flexible material extends through the first pair of openings on the first side and through the second pair of openings on the first side so that the first continuous-loop can be selectively pulled to extend outward from the second pair of openings of the first side to form a loop handle extending from the second pair of openings in the first side and can be selectively pulled to extend outward from the first pair of openings of the first side to form a loop handle extending from the first pair of openings of the first side. A second continuous-loop of flexible material extends through the first pair of openings on the second side and through the second pair of openings on the second side so that the second continuous-loop can be selectively pulled to extend outward from the second pair of openings of the second side to form a loop handle extending from the second pair of openings of the second side and can be selectively pulled to extend outward from the first pair of openings of the second side to form a loop handle extending from the first pair of openings of the second side.

Also disclosed is convertible handbag comprising, in combination, a body having a first side, a second side opposed to the first side, and a bottom. The body forms an interior compartment between the sides and above the bottom and an access opening opposite the bottom for accessing the interior compartment. The body has a bottom portion including the bottom, a top portion including the access opening, and an intermediate portion connecting the top and bottom portions. The top portion of the body is foldable into and out of the interior compartment to selectively convert the body between a first configuration in which the top portion extends upward from the intermediate portion and a second configuration in which the top portion is located within the interior compartment inward of the intermediate portion. The first side has a first pair of spaced-apart openings located in the intermediate portion of the body and a second pair of spaced apart openings located in the top portion of the body. The second side has a first pair of spaced-apart openings located in the intermediate portion of the body and a second pair of spaced apart openings located in the top portion of the body. A first continuous-loop of flexible material extends through the first pair of openings on the first side and through the second pair of openings on the first side so that the first continuous-loop can be selectively pulled to extend outward from the second pair of openings of the first side to form a loop handle extending from the second pair of openings in the first side when the body is in the first configuration and can be selectively pulled to extend outward from the first pair of openings of the first side to form a loop handle extending from the first pair of openings of the first side when the body is in the second configuration. A second continuous-loop of flexible material extends through the first pair of openings on the second side and through the second pair of openings on the second side so that the second continuous-loop can be selectively pulled to extend outward from the second pair of openings of the second side to form a loop handle extending from the second pair of openings of the second side when the body is in the first configuration and can be selectively pulled to extend outward from the first pair of openings of the second side to form a loop handle extending from the first pair of openings of the second side when the body is in the second configuration.

Also disclosed is a handbag convertible between a tote configuration and a purse configuration. The handbag comprises, in combination, a body having a front side, a rear side opposed to the front side, and a bottom. The body forms an interior compartment between the front and rear sides and above the bottom and an access opening opposite the bottom for accessing the interior compartment. The body has a bottom portion including the bottom, a top portion including the access opening, and an intermediate portion connecting the top and bottom portions. The top portion of the body is foldable into and out of the interior compartment to selectively convert the body between the tote configuration in which the top portion extends upward from the intermediate portion and the purse configuration in which the top portion is located within the interior compartment inward of the intermediate portion. The front side has a bottom pair of spaced-apart openings located in the intermediate portion of the body and a top pair of spaced apart openings located in the top portion of the body. The second side has a bottom pair of spaced-apart openings located in the intermediate portion of the body and a top pair of spaced apart openings located in the top portion of the body. A front continuous-loop of flexible material extends through the bottom pair of openings on the front side and through the top pair of openings on the front side so that the front continuous-loop can be selectively pulled to extend outward from the top pair of openings of the front side to form a loop handle extending from the top pair of openings in the front side when the body is in the tote configuration and can be selectively pulled to extend outward from the bottom pair of openings of the front side to form a loop handle extending from the bottom pair of openings of the front side when the body is in the purse configuration. A rear continuous-loop of flexible material extends through the bottom pair of openings on the rear side and through the top pair of openings on the rear side so that the rear continuous-loop can be selectively pulled to extend outward from the top pair of openings of the rear side to form a loop handle extending from the top pair of openings of the rear side when the body is in the tote configuration and can be selectively pulled to extend outward from the bottom pair of openings of the rear side to form a loop handle extending from the bottom pair of openings of the rear side when the body is in the purse configuration.

From the foregoing disclosure and the following more detailed description of various preferred embodiments it will be apparent to those skilled in the art that the present invention provides a significant advance in the technology and art of convertible handbags. Particularly significant in this regard is the potential the invention affords for a convertible handbag that is relatively easy to use, relatively inexpensive to produce and assemble, and aesthetically appealing. Additional features and advantages of various embodiments of the invention will be better understood in view of the detailed description provided below.

BRIEF DESCRIPTION OF THE DRAWINGS

These and further features of the present invention will be apparent with reference to the following description and drawing, wherein.

Figure 1:
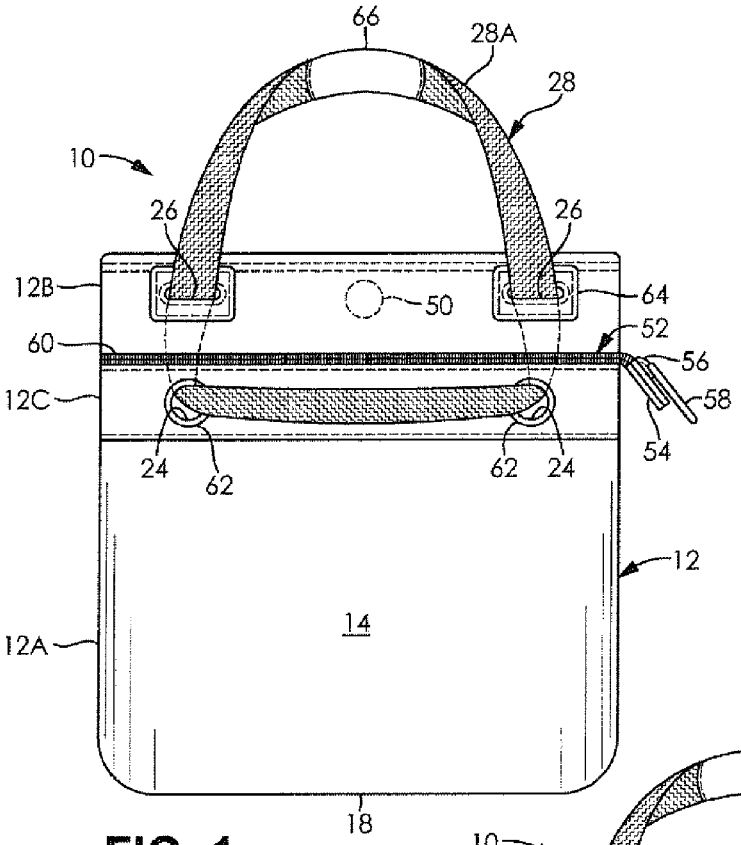
FIG. 1 is a front elevational view of a handbag in a tote configuration according to the present invention.
Figure 2:
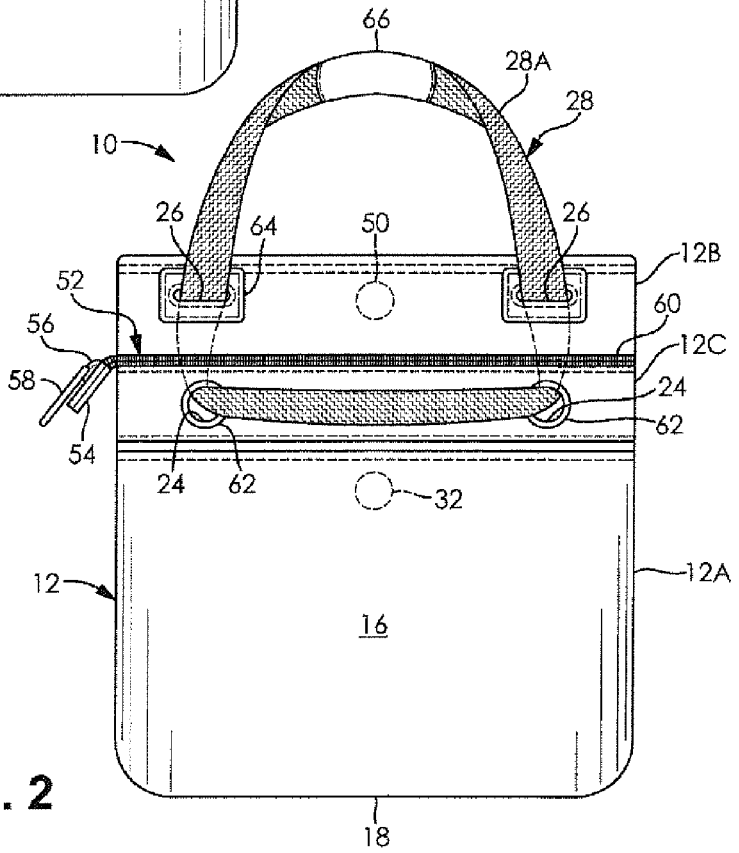
FIG. 2 is a rear elevational view of the handbag of FIG. 1.
Figure 3:
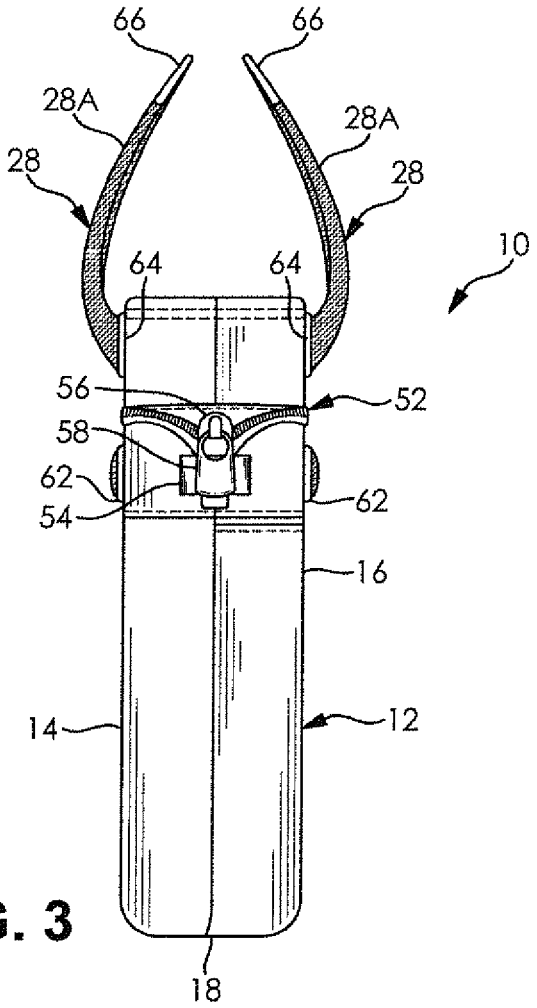
FIG. 3 is a left side elevational view of the handbag of FIGS. 1 and 2.
Figure 4:
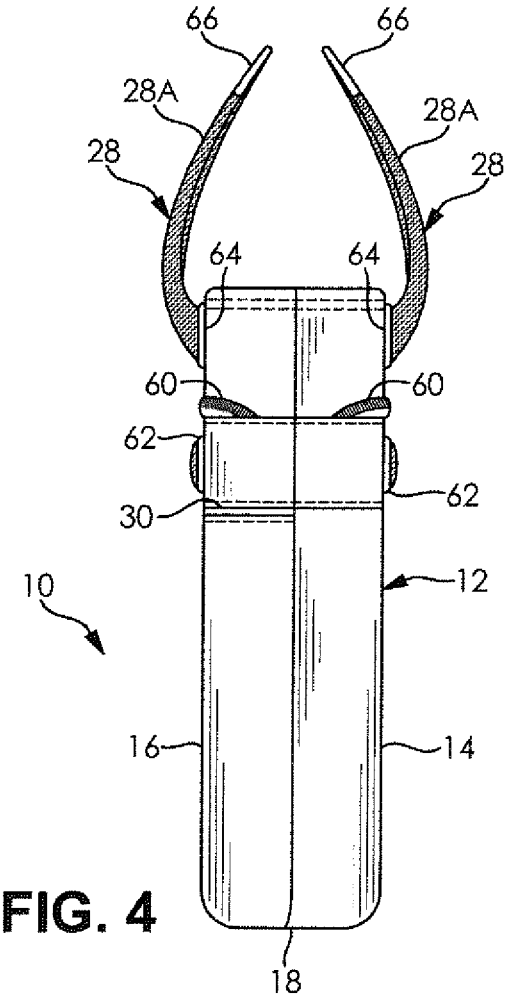
FIG. 4 is a right side elevational view of the handbag of FIGS. 1 to 3.
Figure 5:
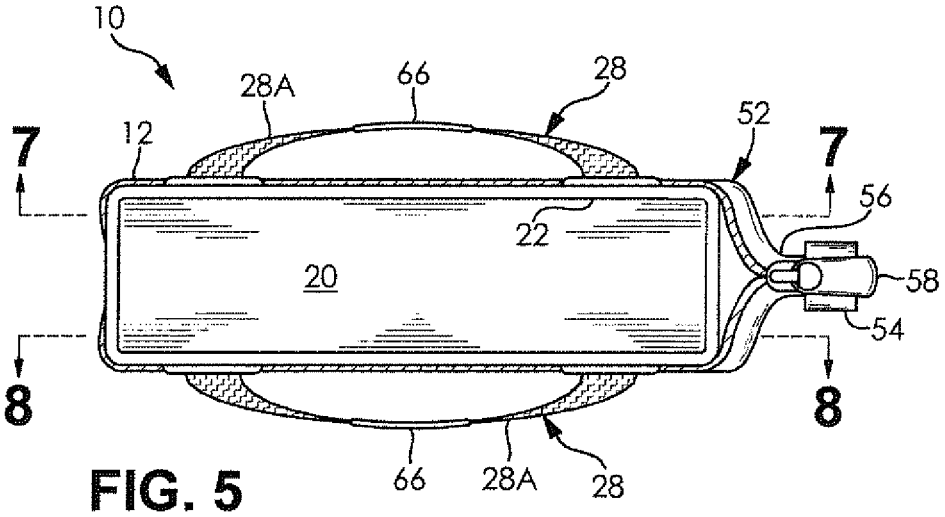
FIG. 5 is a top plan view of the handbag of FIGS. 1 to 4.
Figure 6:
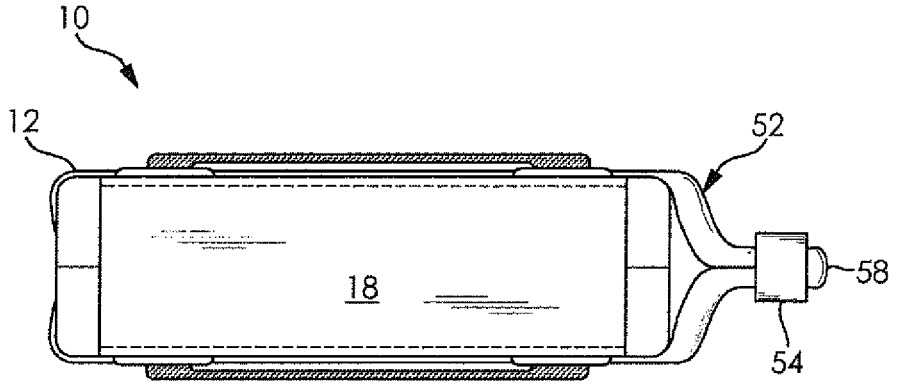
FIG. 6 is a bottom plan view of the handbag of FIGS. 1 to 5.

It should be understood that the appended drawings are not necessarily to scale, presenting a somewhat simplified representation of various preferred features illustrative of the basic principles of the invention. The specific design features of the handbags as disclosed herein, including, for example, specific dimensions and shapes of the various components will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the handbags illustrated in the drawings. In general, up or upward refers to an upward direction within the plane of the paper in FIG. 1 and down or downward refers to a downward direction within the plane of the paper in FIG. 1. Also in general, front or forward refers to a direction out of the plane of the paper in FIG. 1 and rear or rearward refers to a direction facing into the plane of the paper in FIG. 1.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved convertible handbags disclosed herein. The following detailed discussion of various alternative embodiments will illustrate the general principles of the invention. Other embodiments suitable for other applications will be apparent to those skilled in the art given the benefit of this disclosure.

FIGS. 1 to 6 illustrate a handbag 10 according to the present invention. The illustrated handbag 10 includes a body 12 having a first or front side 14, a second or rear side 16 opposed to the front side 14, and a base or bottom 18. The body 12 forms an interior cavity or compartment 20 between the front and rear sides 14, 16 and above the bottom 18. The body 12 also forms an access opening 22 opposite the bottom 18 for accessing the interior compartment 20. The front side 14 has a first or bottom pair of spaced-apart openings 24 and a second or top pair of spaced apart openings 26. The rear side 16 also has a first or bottom pair of spaced-apart openings 24 and a second or top pair of spaced apart openings 26. A first or front continuous-loop 28 of flexible material extends through both the top and bottom pairs of openings 24, 26 on the front side so that the front continuous-loop 26 can be selectively pulled to extend outward from the top pair of openings 26 to form a loop handle 28A extending from the top pair of openings 26 and can be selectively pulled to extend outward from the bottom pair of openings 24 to form a loop handle 28B extending from the bottom pair of openings 24. Similarly, a second or rear continuous-loop of flexible material 26 extends through both the top and bottom pairs of openings 24, 26 on the rear side so that the rear continuous-loop 28 can be selectively pulled to extend outward from the top pair of openings 26 to form a loop handle 28A extending from the top pair of openings 26 and can be selectively pulled to extend outward from the bottom pair of openings 24 to form a loop handle 28B extending from the bottom pair of openings 24. Thus, the continuous loops 28 can form loop handles 28A, 28B in two different configurations depending on whether they extend from the bottom or top pairs of openings 24, 26. In each configuration the front and rear loop handles 28A, 28B cooperate so that the user can carry the handbag 10 by gripping the loop handles 28A, 28B which support the handbag 10.

The term "handbag" is used in this specification and the claims to mean a container used for carrying money, small personal items or accessories, or the like (especially by women) including, but not limited to, athletic bags baguette bags, barrel bags, bowling bags, bucket bags, clutches, doctor's bags, duffel bags, evening bags, feed bags, handbags, hobo bags, messenger bags, pocketbooks, pouches, purses, saddle bags, satchels, shoulder bags, sling bags, totes, weekend bags, and the like.

The illustrated body 12 includes the first or front side 14 and the second or rear side 14 which cooperate to form the opposed front and rear sides of the interior compartment 20. The illustrated body 12 also includes base or bottom 18 that forms a lower side of the interior compartment 20. The illustrated interior compartment 20 is closed except for the access opening 22 formed by the body 12 opposite the bottom 18 but other suitable configurations can be utilized. The interior compartment 20 is sized in any desired manner for storing personal items. It should be appreciated that the base can alternatively have any other suitable configuration.

The illustrated body 12 is also provided with an exterior pocket 30 formed on the exterior of the front side 14. It is noted that the illustrated exterior pocket 30 can be eliminated, have a different size or shape, or be located at a different location on the body 12 and/or more than one exterior pocket 30 can be utilized if desired. The illustrated exterior pocket 30 is provided with a releasable fastener or closure 23 in the form of a snap but any other suitable closure can alternatively be utilized such as, for example, buckles, buttons, clips, hook and loop fasteners (such as Velcro), magnets, straps, ties, turn locks, zippers, and the like.

Figure 7:
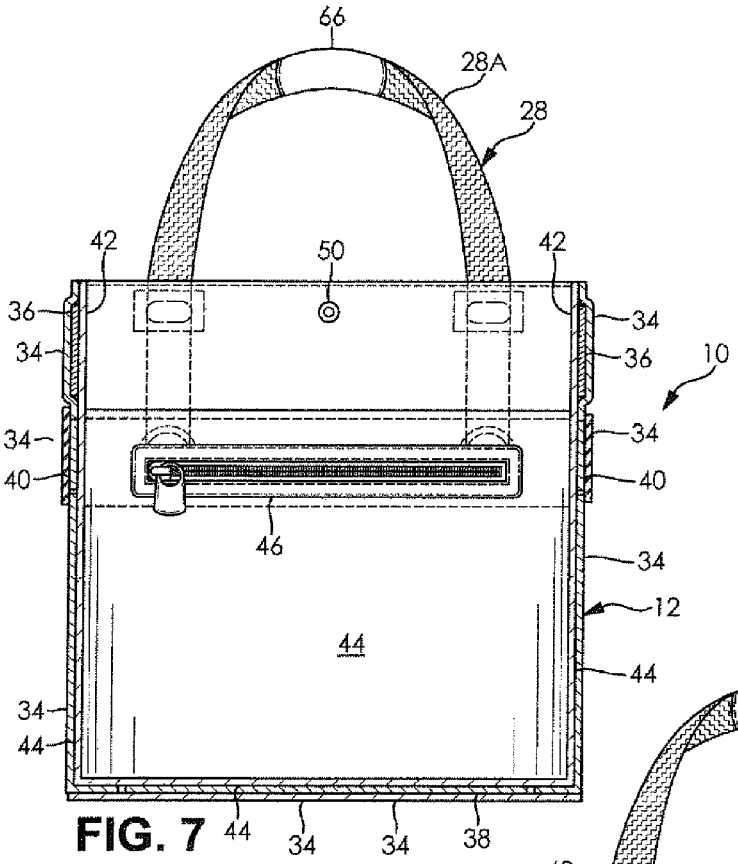
FIG. 7 is a sectional view taken along line 7-7 of FIG. 5 showing an interior rear side of the handbag of FIGS. 1 to 6.
Figure 8:
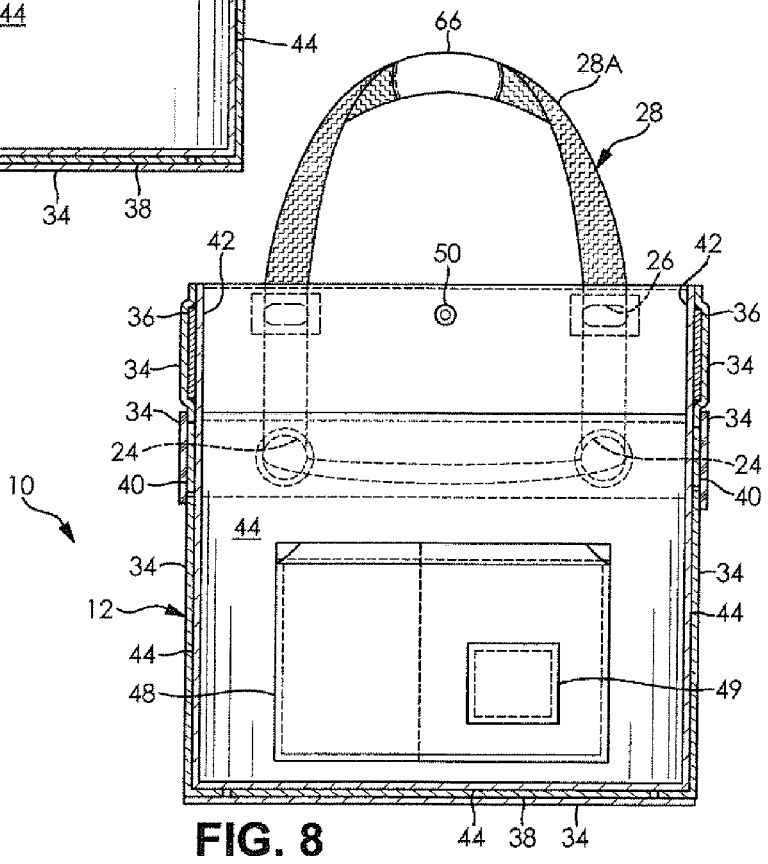
FIG. 8 is a sectional view taken along line 8-8 of FIG. 5 showing an interior front side of the handbag of FIGS. 1 to 6.
Figure 11:
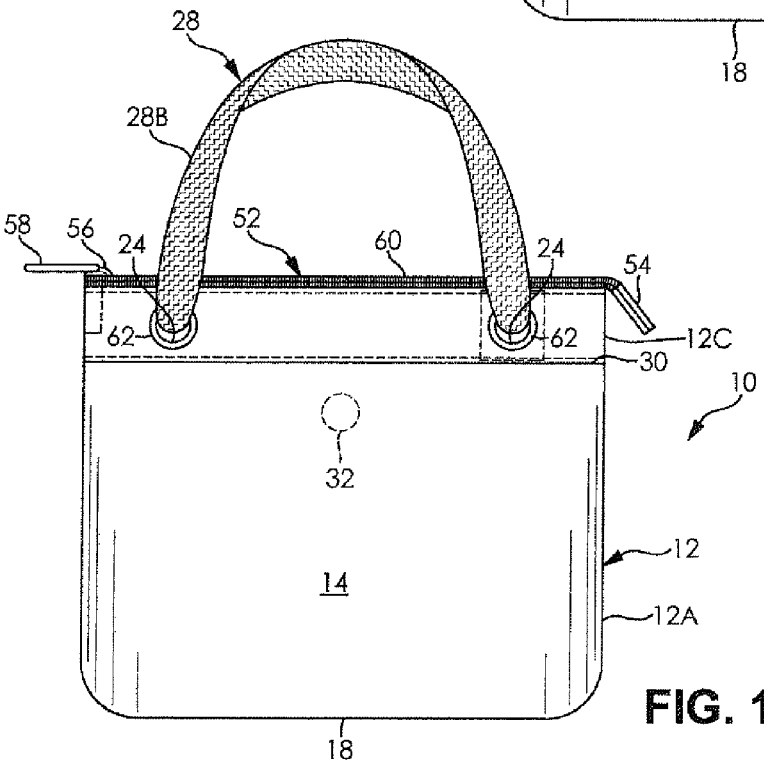
FIG. 11 is a front elevational view similar to FIG. 9, but wherein the handbag is fully converted to a purse configuration.

As best shown in FIGS. 7 and 8, the illustrated body 12 has a lower or bottom portion 12A including the bottom 18, an upper or top portion 12B including the access opening 22, and a middle or intermediate portion 12C connecting the bottom and top portions 12A, 12B. The body portions 12A, 12B, 12C are configured so that the top portion 12B of the body 12 is foldable into and out of the interior compartment 20 to selectively convert the body 12 between a first configuration in which the top portion 12B extends upward from the intermediate portion 12C in an extending manner so that the top portion 12B forms the top edge of the handbag 10 and the access opening 22 (best shown in FIG. 1) and a second configuration in which the top portion 12B is located within the interior compartment 20 inward of the intermediate portion 12C so that the intermediate portion 12C forms the top edge of the handbag 10 and the access opening 22 (best shown in FIG. 11).

The illustrated body 12 is constructed of panels 34 of polyester fabric such as such as, for example, 900D poly but the body 12 can alternatively be formed by any other suitable fabric, natural or synthetic leather, or nonwoven material. The illustrated top portion 12B and the bottom 18 of the bottom portion 12A are each provided with stiffening panels 36, 38 so that the top portion 12B and bottom 18 are stiffer than the remainder of the bottom portion 12A and the bottom 18 is stiffer than the top portion 12B. The illustrated stiffening panel 36 of the top portion 12B comprises a 2 mm hard EVA panel but any other suitable size or type of material can alternatively be utilized. The illustrated stiffening panel 38 of the bottom 18 comprises a 6 mm hard EVA panel but any other suitable size or type of material can alternatively be utilized. The illustrated intermediate portion 12C is provided with a stiffening panel 40 so that the intermediate portion 12C is stiffer than the top portion 12B and the bottom 18. The illustrated stiffening panel 40 is a nonwoven board but any other suitable size or type of material can alternatively be utilized. The inner side of the illustrated top portion 12B of the body 12 is provided with inner panels 42 of polyester fabric of the same material as forming the outer side of the body 12 such as such as, for example, 900D poly but any other suitable fabric, natural or synthetic leather, or nonwoven material can alternatively be utilized. The illustrated inner sides of the intermediate and bottom portions 12C, 12A are provided with a non-woven interlining or liner 44 such as 100% polyester or the like but any other suitable material can alternatively be utilized. If desired, a light foam material can be provided between the fabric panels 34 and the liner 44. The illustrated components of the body 12 are sewn together with stitching but can alternatively be secured together in any other suitable manner. It should be appreciated that the body 12 can alternatively be constructed in any other suitable manner.

As best shown in FIG. 7, the inner side of the illustrated rear side 16 is provided with a zippered pocket 46 within the interior compartment 20. As best shown in FIG. 8, the inner side of the illustrated front side 14 is provided with a pair of contiguous open pockets 48 within the interior compartment 20. A label 49 is also provided on the inner side of the illustrated front side 14. It is noted that the interior compartment 20 can alternatively be configured in any other suitable manner in order to organize and/or store items within the handbag 10.

Figure 10:
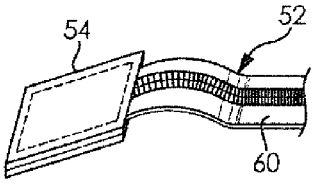
FIG. 10 is an enlarged, fragmented perspective view showing a zipper extension of the handbag in the purse configuration of FIG. 9.
Figure 9:
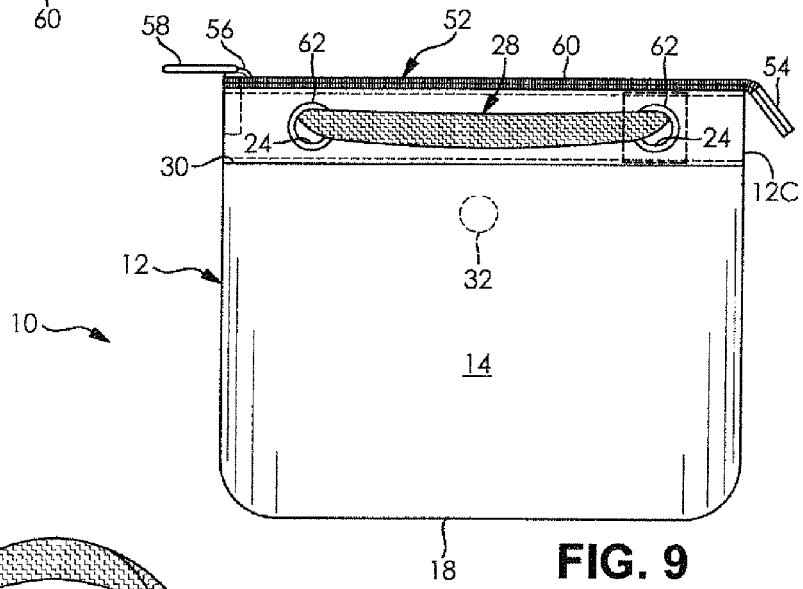
FIG. 9 is a front elevational view of the handbag of FIGS. 1 to 8, but wherein the handbag is partially converted to a purse configuration.

As best shown in FIGS. 1 to 4, the illustrated body 12 is provided with a first fastener or closure 50 for releasably closing the access opening 22 when the body 12 is in its first configuration and a second fastener or closure 52 for releasably closing the access opening 22 when the body 12 is in its second configuration. The illustrated first closure 50 is a magnetic snap having male and female portions secured to the opposed inner sides of the front and rear sides 14, 16 near the top edge of the top portion 12B but any other suitable closure can alternatively be utilized such as, for example, buckles, buttons, clips, hook and loop fasteners (such as Velcro), magnets, straps, ties, turn locks, zippers, and the like. The illustrated second closure 50 is a zipper secured to the opposed outer sides of the front and rear sides 14, 16 near the top edge of the intermediate portion 12C but any other suitable closure can alternatively be utilized such as, for example, buckles, buttons, clips, hook and loop fasteners (such as Velcro), magnets, snaps, straps, ties, turn locks, and the like. One end of the zipper 52 is provided with a zipper extension 54 (best shown in FIG. 10) which extends from a left side of the illustrated intermediate portion 12C so that the zipper's slider 56 along with the pull 58 can be positioned laterally away from the body 12 when the zipper 52 is open so that the top portion 12B of the body 12 can extend upward from the intermediate portion 12C of the body 12 without interference by the zipper 52 (best shown in FIG. 10). When the body 12 is in its first configuration, the zipper 52 is unsecured or unzipped so that the top portion 12B can upwardly extend from the intermediate portion 12C and the zipper's slider 56 along with the pull 58 are located at the extension 54 while the two rows of teeth 60 extend across the opposed outer sides of the body 12 (best shown in FIGS. 1 to 4). When the body 12 is in its second configuration, the zipper 52 can be selectively secured or zipped because the rows of teeth 60 are adjacent one another at the top of the body 12. When secured or zipped, the zipper's slider 56 along with the pull 58 are located at the side of the body opposite the extension 54 while the two rows of teeth 60 are interconnected to close the access opening 22 of the body 12 (best shown in FIGS. 9 to 11).

The illustrated bottom pair of openings 24 in both the front and rear sides 14, 16 are located in the intermediate portion 12C of the body 12 and are each circular shaped so that the continuous loops 28 can easily turn therein when the body 12 is in the first configuration. The illustrated top pair of openings 26 in both the front and rear sides 14, 16 are located in the top portion 12B of the body 12 and are each slot or flat oval shaped so that the continuous loop 28 exits the top openings 26 substantially parallel to the outer surface of the top portion 12B of the body 12 when the body 12 is in its first configuration and supported by the handles 28A, 28B. It is noted that either of the pairs of openings can alternatively have any other suitable shape. The illustrated bottom pair of openings 24 are at the same height and laterally spaced apart and the illustrated top pair of openings 26 are at the same height and laterally spaced apart and located directly above the bottom pair of openings 24. The illustrated bottom pair of openings 24 are each provided with a metal grommet 62 but they can alternatively be reinforced in any other suitable manner. The illustrated top pair of openings 26 are each provided with a reinforcement patch 64 but they can alternatively be reinforced in any other suitable manner. The illustrated reinforcement patch 64 comprises a synthetic leather but any other suitable material can alternatively be utilized.

The illustrated front and rear continuous-loops 28 of flexible material form the pair of loop handles 28A, 28B as described above with one handle 28A secured to the front side 14 and the other handle 28B secured to the rear side 16. The illustrated front and rear continuous-loops 28 are continuous loops in that they are endless, that is, in the form of a circle with no end (best shown in FIG. 8). The illustrated front and rear continuous-loops 28 comprise nylon web having a width of about 1 inch but any other suitable size and/or material can alternatively be utilized. The illustrated front and rear continuous-loops 28 are each provided with a hand grip 66 located on portions of the continuous loops 28 located between the top openings 26 so that the grips 66 are utilized when the continuous loops 28 are in their first configuration. The illustrated hand grips 66 comprise a synthetic leather but any other suitable material can alternatively be utilized.

The illustrated first or front continuous-loop 28 continuously extends between the bottom pair of openings 24 of the front side 14 at an exterior of the front side 14, between a first one of the bottom pair of openings 24 of the front side 14 and a first one of the top pair of openings 26 of the front side 14 at an interior of the front side 14, between the top pair of openings 26 of the front side 14 at an exterior of the front side 14, and between a second one of the top pair of openings 26 of the front side 14 and a second one of the bottom pair of openings 26 of the front side 14 at an interior of the front side 14. Thus, the illustrated front continuous loop 28 continuously extends through each of the two pairs of openings 24, 26 in the front side 14 in an endless or continuous manner. Configured in this manner, the front continuous-loop 28 can be selectively pulled to extend outward from the top pair of openings 26 to form the loop handle 28A extending from the top pair of openings 26 (the first handle configuration, best shown in FIG. 1) and can be selectively pulled to extend outward from the bottom pair of openings 24 to form a loop handle 28B extending from the bottom pair of openings 24 (the second handle configuration, best shown in FIG. 11). The illustrated rear continuous loop 28 has the same configuration and operation as the illustrated front continuous loop 28 except that it is secured to the rear side 16 rather than the front side 14 so the description will not be repeated.

As best shown in FIGS. 7 and 8, the liner 44 within the body 12 covers each of the bottom pairs of openings 24 within the interior compartment 20. Thus, only the liner 44 can be viewed through the bottom openings 24. This is particularly desirable when the body 12 is in its second configuration so that the top portion 12B of the body 12 cannot be viewed through the bottom pairs of openings 24. The top inner panels 42 of the illustrated top portion 12B cover each of the upper pairs of openings 26 within the interior compartment 20. Thus, the top inner panels 42 and the liner 44 cooperate to cover the portions of the continuous loops 28 and all of the bottom and top pairs of openings 24, 26 within the interior compartment 20. This configuration provides a more visually pleasing appearance to the interior compartment 20 and also prevents items located within the interior compartment 20 from interfering with the continuous loops 28 within the interior compartment 20.

The illustrated handbag 10 is configured to be convertible between a tote and a purse. When the body 12 of the handbag 10 is in its first configuration with the top portion 12B extending upward from the intermediate portion 12C and the continuous loops 28 are in their first configuration with the loop handles 28A formed to extend from the top pairs of openings 26, the handbag 10 is in a first or tote configuration (best shown in FIG. 1). When the body 12 of the handbag 10 is in its second configuration with the top portion 12B folded inward of the intermediate portion 12C and the continuous loops 28 are in their second configuration with the loop handles 28B formed to extend from the bottom pairs of openings 24, the handbag 10 is in a second or purse configuration (best shown in FIG. 11). To convert the handbag 10 from the tote configuration to the purse configuration, the top portion 12B of the body 12 is folded inwardly into the interior compartment 20 until it is inwardly adjacent the intermediate portion 12C (best shown in FIG. 9). The continuous loops 28 are then each grasped between the bottom pairs of openings 24 on the outside of the body 12 and pulled until the loop handles 28B extend from the bottom pairs of openings 24 and the continuous loops 28 extend directly between the top pairs of openings 26 (best shown in FIG. 11). It is noted that these two steps can alternatively be performed in the reverse order. To convert the handbag 10 from the purse configuration to the tote configuration, the top portion 12B of the body 12 is folded upwardly out the interior compartment 20 until it extends upwardly from the intermediate portion 12C (best shown in FIG. 1). The continuous loops 28 are then each grasped between the top pairs of openings 26 on the outside of the body 12 and pulled until the loop handles 28A extend from the top pairs of openings 26 and the continuous loops 28 extend directly between the bottom pairs of openings 24 (best shown in FIG. 11). It is noted that these two steps can alternatively be performed in the reverse order. It is also noted that the handbag 10 can alternatively be configured to be converted between any other combination of types or styles of handbags 10.

Any of the features or attributes of the above described embodiments and variations can be used in combination with any of the other features and attributes of the above described embodiments and variations as desired.

From the foregoing disclosure it will be apparent that the present invention provides an improved handbag which enables a single handbag to be easily converted between to different styles or types. Additionally, the improved handbag enables a single continuous loop to be converted between two different handle configurations.

From the foregoing disclosure and detailed description of certain preferred embodiments, it will be apparent that various modifications, additions and other alternative embodiments are possible without departing from the true scope and spirit of the present invention. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A handbag comprising, in combination:

a body having a first side, a second side opposed to the first side, and a bottom;

wherein the body forms an interior compartment between the sides and above the bottom and an access opening opposite the bottom for accessing the interior compartment;

wherein the first side has a first pair of spaced-apart openings and a second pair of spaced apart openings;

wherein the second side has a first pair of spaced-apart openings and a second pair of spaced apart openings;

a first continuous-loop of flexible material extending through the first pair of openings on the first side and through the second pair of openings on the first side so that the first continuous-loop can be selectively pulled to extend outward from the second pair of openings of the first side to form a loop handle extending from the second pair of openings in the first side and can be selectively pulled to extend outward from the first pair of openings of the first side to form a loop handle extending from the first pair of openings of the first side;

a second continuous-loop of flexible material extending through the first pair of openings on the second side and through the second pair of openings on the second side so that the second continuous-loop can be selectively pulled to extend outward from the second pair of openings of the second side to form a loop handle extending from the second pair of openings of the second side and can be selectively pulled to extend outward from the first pair of openings of the second side to form a loop handle extending from the first pair of openings of the second side; and wherein the first continuous-loop of flexible material and the second continuous-loop of flexible material each comprise a continuous-loop of webbing, the first pair of spaced-apart openings on the first side and the first pair of spaced-apart openings on the second side are each circular shaped, and the second pair of spaced-apart openings on the first side and the second pair of spaced-apart openings on the second side are each slot shaped.

2. The handbag according to claim 1, wherein the first continuous-loop extends between the first pair of openings of the first side exterior of the first side, between a first one of the first pair of openings of the first side and a first one of the second pair of openings of the first side interior of the first side, and between a second one of the first pair of openings of the first side and a second one of the second pair of openings of the first side interior of the first side, and wherein the second continuous-loop extends between the first pair of openings of the second side exterior of the second side, between a first one of the first pair of openings of the second side and a first one of the second pair of openings of the second side interior of the second side, and between a second one of the first pair of openings of the second side and a second one of the second pair of openings of the second side interior of the second side.

3. The handbag according to claim 1, wherein the first pair of openings in the first side and the first pair of openings in the second side are each provided with a metal grommet.

4. The handbag according to claim 1, wherein the first pair of openings in the first side and the first pair of openings in the second side are each provided with a reinforcement patch.

5. The handbag according to claim 1, wherein the first continuous-loop is provided with a grip secured to the first continuous-loop along a portion between the second pair of openings in the first side and wherein the second continuous-loop is provided with a grip secured to the second continuous-loop along a portion between the second pair of openings in the second side, and wherein the grips each comprise a material different than the flexible material of the first continuous-loop of flexible material and the second continuous-loop of flexible material.

6. The handbag according to claim 1, further comprising a liner within the body and covering the first pair of openings in the first side and the first pair of openings in the second side.

7. The handbag according to claim 6, wherein the liner covers at least a portion of the first continuous loop between a first one of the first pair of openings of the first side and a first one of the second pair of openings of the first side, and covers at least a portion of the second continuous loop between a second one of the first pair of openings of the second side and a first one of the second pair of openings of the second side.

8. The handbag according to claim 1, wherein the first pair of openings of the first side are at the same height and laterally spaced apart and the second pair of openings of the first side are at the same height and laterally spaced apart and located directly above the first pair of openings in the first side, and wherein the first pair of openings of the second side are at the same height and laterally spaced apart and the second pair of openings of the second side are at the same height and laterally spaced apart and located directly above the first pair of openings of the second side.

9. The handbag according to claim 1, wherein the body has a bottom portion including the bottom, a top portion including the access opening, and an intermediate portion connecting the top and bottom portions, and wherein the top portion is provided with a first stiffening panel, the bottom is provided with a second stiffening panel, and the intermediate portion is provided with a third stiffening panel so that the top portion and the bottom are stiffer than a remainder of the bottom portion, the bottom is stiffer than the top portion, and the intermediate portion is stiffer than the top portion and the bottom.

10. A convertible handbag comprising, in combination:

a body having a first side, a second side opposed to the first side, and a bottom;

wherein the body forms an interior compartment between the sides and above the bottom and an access opening opposite the bottom for accessing the interior compartment;

wherein the body has a bottom portion including the bottom, a top portion including the access opening, and an intermediate portion connecting the top and bottom portions;

wherein the top portion is provided with a first stiffening panel, the bottom is provided with a second stiffening panel, and the intermediate portion is provided with a third stiffening panel so that the top portion and the bottom are stiffer than a remainder of the bottom portion, the bottom is stiffer than the top portion, and the intermediate portion is stiffer than the top portion and the bottom;

wherein the top portion of the body is foldable into and out of the interior compartment to selectively convert the body between a first configuration in which the top portion extends upward from the intermediate portion and a second configuration in which the top portion is located within the interior compartment inward of the intermediate portion;

wherein the first side has a first pair of spaced-apart openings located in the intermediate portion of the body and a second pair of spaced apart openings located in the top portion of the body;

wherein the second side has a first pair of spaced-apart openings located in the intermediate portion of the body and a second pair of spaced apart openings located in the top portion of the body;

a first continuous-loop of flexible material extending through the first pair of openings on the first side and through the second pair of openings on the first side so that the first continuous-loop can be selectively pulled to extend outward from the second pair of openings of the first side to form a loop handle extending from the second pair of openings in the first side when the body is in the first configuration and can be selectively pulled to extend outward from the first pair of openings of the first side to form a loop handle extending from the first pair of openings of the first side when the body is in the second configuration; and a second continuous-loop of flexible material extending through the first pair of openings on the second side and through the second pair of openings on the second side so that the second continuous-loop can be selectively pulled to extend outward from the second pair of openings of the second side to form a loop handle extending from the second pair of openings of the second side when the body is in the first configuration and can be selectively pulled to extend outward from the first pair of openings of the second side to form a loop handle extending from the first pair of openings of the second side when the body is in the second configuration.

11. The handbag according to claim 10, wherein the first continuous-loop extends between the first pair of openings of the first side exterior of the first side, between a first one of the first pair of openings of the first side and a first one of the second pair of openings of the first side interior of the first side, and between a second one of the first pair of openings of the first side and a second one of the second pair of openings of the first side interior of the first side, and wherein the second continuous-loop extends between the first pair of openings of the second side exterior of the second side, between a first one of the first pair of openings of the second side and a first one of the second pair of openings of the second side interior of the second side, and between a second one of the first pair of openings of the second side and a second one of the second pair of openings of the second side interior of the second side.

12. The handbag according to claim 10, further comprising a first releasable closure located on the top portion of the body for selectively closing the access opening when the body is in the first configuration, and a second releasable closure for selectively closing the access opening when the body is in the second configuration.

13. The handbag according to claim 12, wherein the second releasable closure is a zipper located at a top of the intermediate portion.

14. The handbag according to claim 10, wherein the first continuous loop is provided with a grip secured to the first continuous-loop along a portion between the second pair of openings in the first side and wherein the second continuous loop is provided with a grip secured to the first continuous-loop along a portion between the second pair of openings in the second side, and wherein the grips each comprise a material different than the flexible material of the first continuous-loop of flexible material and the second continuous-loop of flexible material.

15. The handbag according to claim 10, further comprising a liner within the body and covering the first pair of openings in the first side and the first pair of openings in the second side.

16. The handbag according to claim 15, wherein the liner covers at least a portion of the first continuous loop between a first one of the first pair of openings of the first side and a first one of the second pair of openings of the first side, and covers at least a portion of the second continuous loop between a second one of the first pair of openings of the second side and a first one of the second pair of openings of the second side.

17. The handbag according to claim 10, wherein the first pair of openings of the first side are at the same height and laterally spaced apart and the second pair of openings of the first side are at the same height and laterally spaced apart and located directly above the first pair of openings in the first side, and wherein the first pair of openings of the second side are at the same height and laterally spaced apart and the second pair of openings of the second side are at the same height and laterally spaced apart and located directly above the first pair of openings of the second side.

18. The handbag according to claim 10, wherein the first continuous-loop of flexible material and the second continuous-loop of flexible material each comprise a continuous-loop of webbing, the first pair of spaced-apart openings on the first side and the first pair of spaced-apart openings on the second side are each circular shaped, and the second pair of spaced-apart openings on the first side and the second pair of spaced-apart openings on the second side are each slot shaped.

19. A handbag convertible between a tote configuration and a purse configuration, the handbag comprising, in combination:

a body having a front side, a rear side opposed to the front side, and a bottom;

wherein the body forms an interior compartment between the front and rear sides and above the bottom and an access opening opposite the bottom for accessing the interior compartment;

wherein the body has a bottom portion including the bottom, a top portion including the access opening, and an intermediate portion connecting the top and bottom portions;

wherein the top portion is provided with a first stiffening panel, the bottom is provided with a second stiffening panel, and the intermediate portion is provided with a third stiffening panel so that the top portion and the bottom are stiffer than a remainder of the bottom portion, the bottom is stiffer than the top portion, and the intermediate portion is stiffer than the top portion and the bottom;

wherein the top portion of the body is foldable into and out of the interior compartment to selectively convert the body between the tote configuration in which the top portion extends upward from the intermediate portion and the purse configuration in which the top portion is located within the interior compartment inward of the intermediate portion;

wherein the front side has a bottom pair of spaced-apart openings located in the intermediate portion of the body and a top pair of spaced-apart openings located in the top portion of the body;

wherein the bottom side has a bottom pair of spaced-apart openings located in the intermediate portion of the body and a top pair of spaced-apart openings located in the top portion of the body;

a front continuous-loop of flexible material extending through the bottom pair of openings on the front side and through the top pair of openings on the front side so that the front continuous-loop can be selectively pulled to extend outward from the top pair of openings of the front side to form a loop handle extending from the top pair of openings in the front side when the body is in the tote configuration and can be selectively pulled to extend outward from the bottom pair of openings of the front side to form a loop handle extending from the bottom pair of openings of the front side when the body is in the purse configuration;

a rear continuous-loop of flexible material extending through the bottom pair of openings on the rear side and through the top pair of openings on the rear side so that the rear continuous-loop can be selectively pulled to extend outward from the top pair of openings of the rear side to form a loop handle extending from the top pair of openings of the rear side when the body is in the tote configuration and can be selectively pulled to extend outward from the bottom pair of openings of the rear side to form a loop handle extending from the bottom pair of openings of the rear side when the body is in the purse configuration; and wherein the front continuous-loop of flexible material and the rear continuous-loop of flexible material each comprise a continuous-loop of webbing, the top pair of spaced-apart openings on the front side and the top pair of spaced-apart openings on the rear side are each circular shaped, and the bottom pair of spaced-apart openings on the front side and the bottom pair of spaced-apart openings on the rear side are each slot shaped.

20. The handbag according to claim 19, further comprising a releasable closure located on the top portion of the body for selectively closing the access opening when the body is in the tote configuration, and a zipper located at a top of the intermediate portion for selectively closing the access opening when the body is in the purse configuration.

* * * * *